United States Patent [19]

Namiki et al.

[11] 4,329,565

[45] May 11, 1982

[54] IMAGE FIXING DEVICE

[75] Inventors: Ryōichi Namiki, Yokohama; Yūichiro Higashi, Kawasaki, both of Japan

[73] Assignee: Ricoh Co., Ltd., Japan

[21] Appl. No.: 188,944

[22] Filed: Sep. 19, 1980

[30] Foreign Application Priority Data

Sep. 28, 1979 [JP] Japan ..... 54-124874

[51] Int. Cl.[3] ..... H05B 1/00

[52] U.S. Cl. ..... 219/216; 219/469; 219/388; 355/3 FU; 432/60

[58] Field of Search ..... 219/216, 388, 469, 470, 219/471; 432/60, 228; 355/3 R, 3 FU; 427/444

[56] References Cited

U.S. PATENT DOCUMENTS

| | | | |
|---|---|---|---|
| 3,884,181 | 5/1975 | Thettu | 432/60 X |
| 3,902,845 | 9/1975 | Murphy | 432/60 |
| 4,019,024 | 4/1977 | Namiki | 219/469 |
| 4,087,676 | 5/1978 | Fukase | 219/216 |
| 4,150,181 | 4/1979 | Smith | 439/60 X |
| 4,216,327 | 8/1980 | Idstein | 432/60 |

FOREIGN PATENT DOCUMENTS

| | | |
|---|---|---|
| 48-84644 | 11/1973 | Japan . |
| 48-90537 | 11/1973 | Japan . |

*Primary Examiner*—Volodymyr Y. Mayewsky
*Attorney, Agent, or Firm*—McGlew and Tuttle

[57] ABSTRACT

An image fixing device for an electrophotographic copying apparatus and the like including a fixing roller and a pressing roller in pressing contact with each other. The fixing roller includes a metallic core, a resilient material layer and an offset preventing layer superposed one over another in the indicated order and having a heating member disposed therein for heating the metallic core. A copy sheet formed thereon with a toner image is passed between the two rolls so that the toner image will be fixed to the copy sheet by melt adhesion by being pressed between them while being heated. The offset preventing layer has a higher heat intake than the toner image so as to be highly responsive to heat. The offset preventing layer is formed of a material containing a synthetic resinous material, such as silicone rubber, silicone resin, etc., which is highly resistant to heat and which has a high parting property, added with over 1% by weight of metal powder of high thermal conductivity. To prevent the temperature at the surface of the fixing roll from dropping from a level necessary for obtaining satisfactory fixing of images when a plurality of toner images are consecutively fixed, the resilient material layer preferably has a thermal conductivity of over $1\times10^{-3}$ cal/cm.°C. sec.

6 Claims, 5 Drawing Figures

IMAGE FIXING DEVICE

BACKGROUND OF THE INVENTION (1) Field of the Invention

This invention relates to an image fixing device as for a copying apparatus which lets a copy sheet with a toner image formed thereon pass between a fixing roll, heated from inside by a heating member, and a pressing roll maintained in pressing engagement with the fixing roll, to fix the toner image by heating and pressing.

(2) Description of the Prior Art

One type of image fixing device for an electrophotographic copying machine and the like comprises a fixing roll having a heating member, such as an infrared heater, for heating the fixing roll from inside or which is composed of a metallic core directly heated by induction heating, a resilient material layer and an offset preventing layer superposed one over another in the indicated order, and a pressing roll juxtaposed against the fixing roll for pressing a thereagainst. By passing toner image supporting copy sheet between the fixing roll and pressing roll, the toner image is pressed against the outer periphery of the fixing heated roll, to cause the toner image adhere to the copy sheet by melt adhesion.

The resilient material layer, which is provided for bringing the copy sheet into contact with the fixing roll with a suitable degree of resilience and a width of contact, is usually formed of a resilient material of high resistance to heat, such as silicone rubber, fluoroprene rubber, etc., and has a thickness in the order of several millimeters. As subsequently to be described, the resilient material layer should have a sufficiently high thermal capacity to be commensurate with the thermal capacity of the toner image. In order to avoid offsetting of the toner image or adhering of the toner image to the surface of the fixing roller, the offset preventing layer which is superposed over the resilient layer, is formed of a material of high parting capability, such as silicone RTV rubber (KE12, a trade name produced by Sinetsu Chemical Company. Ltd.), fluoride resin (Teflon or polytetrafluoroethylene), etc., and has a small thickness of several scores of microns.

In selecting the material for forming the resilient material layer, it has hitherto been customary to make it a rule to select a material of suitable resilience and high resistance to heat. In selecting the material for the offset preventing layer, it has been customary to select a material of high parting capability and high resistance to heat, but little attention, if any, has ever been paid to the property of a response to heat of materials. Owing to the fact that this property of materials has not been taken into consideration, the image fixing devices of the prior art have had the disadvantage that as a copy sheet is brought into contact with the fixing roll in carrying out fixing, the temperature of the surface of the roll drops, or when fixing a plurality of toner images is carried out continuously, the temperature at the surface of the roll gradually drops, resulting in a lack of heat of an amount required for effecting fixing. When such phenomenon occurs, it has been necessary to raise the temperature of the heating member.

SUMMARY OF THE INVENTION

This invention has been developed for the purpose of obviating the aforesaid disadvantages of the prior art. Accordingly, the invention has as its object the provision of a fixing roll of an image fixing device of high thermal efficiency which shows no reduction in the temperature at the surface of the roll and which is free from the risks of producing poorly fixed toner images of due to a lack of heat when fixing is effected.

The aforesaid object is accomplished according to the invention by providing a fixing roll including an offset preventing layer formed of a material having a higher heat intake than the toner used for forming toner images. The heat intake of a material can be calculated by the following equation:

$$\text{Heat Intake} = \sqrt{\lambda \cdot \rho \cdot C_p}\ (\text{cal/cm}^2\ C \cdot \text{sec}^{\frac{1}{2}})$$

where $\lambda$ (cal/cm·sec.°C.), $\rho$ (g/cm$^3$) and $C_p$ (cal/g.°C.) indicate the thermal conductivity, density and specific heat at constant pressure of the material respectively.

DESCRIPTION OF THE PREFERRED EMBODIMENT

Figure 1:
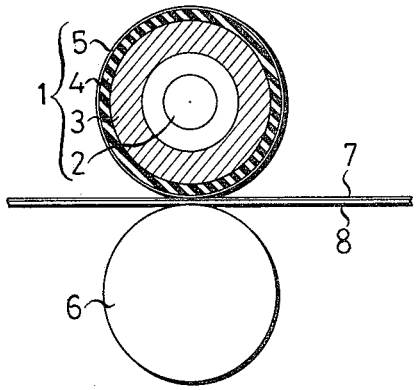
FIG.1 PRIOR ART
FIG. 1 is a sectional view of an image fixing device of the prior art including a heating roll of the conventional type.

A fixing roll of an image fixing device for an electrophotographic copying apparatus which has generally be in use will be described by referring to FIG. 1. The fixing roll 1 of the prior art includes a metallic core 3, a resilient material layer 4 and an offset layer 5, superposed one over another in the indicated order, and has a heating member 2, such as an infrared heater, mounted in the roll 1 for heating the metallic core 3 from inside. A pressing roll 6 is juxtaposed against the fixing roll 1, and a copy sheet 8 having a toner image 7 formed thereon is allowed to pass between the fixing roll 1 and pressing roll 6, to effect fixing of the toner image to the copy sheet 8 by melt adhesion as described hereinabove.

It has been ascertained as the result of experiments and theoretical analysis that the heat intake of the offset preventing layer 5 brought into direct contact with the toner image 7 exerts the greatest influence on a reduction of temperature at the surface of the roll 1 that might be caused by the contact of the copy sheet with the roll surface. It has also been ascertained that by increasing the heat intake $\sqrt{\lambda \cdot \rho \cdot C_p}$ of the offset preventing layer 5 to a level higher than that of the toner image 7, when the offset preventing layer 5 and toner image 7 have the same thickness, marked effects can be achieved in effecting fixing satisfactorily.

The toner image 7 generally contains, by weight, 97–70% of resin and 3–30% of carbon, and has a heat intake of about 0.013 cal/cm$^2$·°C. sec$^{\frac{1}{2}}$.

Figure 2:
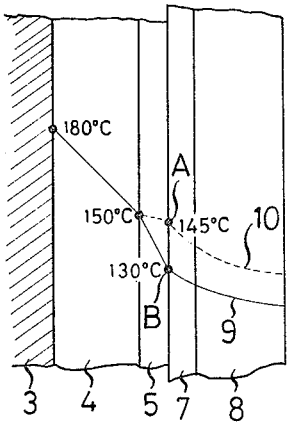
FIG. 2 is a diagram showing the results of tests conducted on the temperature gradient near the surface of the fixing roll by varying the heat intake of the offset preventing layer of the fixing roll.

The results of tests conducted on the influences that would be exerted on the temperature at the surface of the roll 1 by changes in the thermal conductivity $\lambda$ of the offset preventing layer 5 will be described by referring to a drawing. FIG. 2 shows, on an enlarged scale, the copy sheet 8 in contact with the fixing roll 1 in cross section while fixing of the toner image 7 to the copy sheet 8 is being carried out. From left to right of the figure are the metallic core 3, resilient material layer 4, offset preventing layer 5, toner image 7 and copy sheet 8 arranged in layers. In ordinary copies, the toner image 7 exists on the copy sheet 8 and there is little, if any, difference between them in thermal characteristics. Thus the image 7 and layer 8 are considered to constitute an entity, although they are shown as separate entities in the model. A solid line 9 indicates a temperature gradient obtained when the offset preventing layer 5 is formed of silicone rubber alone, and a broken line 10 indicates a temperature gradient obtained when the offset preventing layer 5 is formed of silicone rubber added with 5% by weight of copper powder. As shown in the figure, the surface of the resilient material layer 4 in contact with the metallic core 3 has a temperature of 180° C., and the boundary between the resilient material layer 4 and offset preventing layer 5 has a temperature of 150° C. However, the outer surface of the offset preventing layer 5 has a temperature of 130° C. as shown at point B when the layer 5 is formed of silicone rubber alone but has a temperature of 150° C. as shown at point A when the layer 5 is formed of silicone rubber added with copper powder to increase the thermal conductivity $\lambda$ of the material, showing a difference of 15° C.

The toner image 7 used in the experiments had a composition containing, by weight, 80% of resin and 20% of carbon, with a thermal conductivity of $\lambda=4\times10^{-4}$ and $\rho=1.2$. The copper powder had $\lambda=8.9\times10^{-1}$ and $\rho=8.0$.

Figure 3:
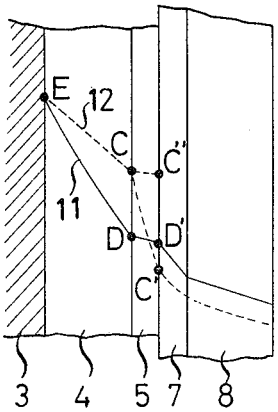
FIG. 3 is a diagram showing the results of tests similar to those shown in FIG. 2 but carried out by varying the heat intake of not only the offset preventing layer but also the resilient material layer.

The results of tests conducted by varying the thermal conductivity of both the resilient material layer 4 and offset preventing layer 5 will be described by referring to a drawing. In FIG. 3, a solid line 11 represents a temperature gradient obtained when the resilient material layer 4 had $\lambda=4\times10^{-4}$ and a thickness of 1.5 mm and the offset preventing layer 5 was formed of KE12 silicone RTV rubber added with 5% by weight of iron oxide and had a thickness of 20$\mu$. A broken line 12 indicate a temperature gradient obtained when the resilient material layer 4 had $\lambda=3\times10^{-3}$ and the offset preventing layer 5 was formed of KE silicone RTV rubber alone. In the temperature gradients indicated by the solid line 11 and broken line 12, the boundary of the resilient material layer 4 and the metallic core 3 has the same temperature as indicated at point E. However, owing to the difference in thermal conductivity between the materials of the resilient material layer 4, the temperature at the surface of the resilient material layer 4 was as shown at point D in the solid line 11 and as shown at point C in the broken line 12. Thus, on the outer surface of the resilient material layer 4, the temperature was higher in the broken line 12 than in the solid line 11. However, after passing through the offset layer 5, the temperatures in the solid line 11 and broken line 12 were reversed, so that the temperature was higher in the solid line 11 as shown at point D′ than in the broken line 12 as shown at point C′. With the material indicated by the solid line 11, complete adhesion of the toner image 7 to the copy sheet 8 was achieved but the material represented by the broken line 12 failed to achieve melt adhesion of the toner image 7 to the copy sheet 8. Thus the results of the tests show that even if the resilient material layer 4 is low in thermal conductivity, addition of copper powder to the material of the offset preventing layer 5 to increase its heat intake enables satisfactory results to be obtained in fixing the toner image 7 to the copy sheet 8. This would show that the boundary between the toner image 7 and the offset layer 5 performs an important role in the transfer of heat, and that in the case of the broken line 12 heat is not much absorbed by the layer 5 because the latter has a low heat intake, so that the layer 4 possesses enough heat and the temperature rises as shown at point C. With regard to the thermal capacity of the layer 4, it would seem that a considerably large thickness of the layer 4 compensates for a slight reduction in thermal conductivity. The results of tests show that addition of metal powder, such as iron oxide powder, has effects when its proportion is over 1% by weight. The fixing roll used in the tests had a diameter of 40 mm and a length of 400 mm and the pressing roll juxtaposed against the fixing roll had a diameter of 40 mm and was coated with a polytetrafluoroethylene layer. The pressure applied to the fixing roll by the pressing roll was 1 kg/cm$^2$, and the heater in the fixing roll had a capacity of 1 kw.

Figure 4:
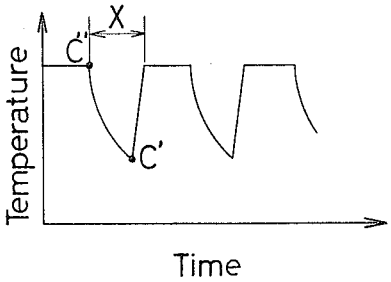
FIG. 4 is a diagram showing chronological changes in the temperature at the surface of the fixing roll.

When the copy sheet 8 was released from the surface of the fixing roll 1 and no load was applied to the latter, the temperature shown at point C′ on the surface of the offset preventing layer 5 rose to a level shown at point C″ which is substantially at the same level as at point C. FIG. 4 shows this change in temperature in chronological sequence. In the diagram shown in FIG. 4 in which the abscissa represents the time and the ordinate indicates the temperature, the temperature-time characteristic is shown in a curve of a serration form. The interval X in time corresponds to the time that elapses before the copy sheet 8 is released from contact with the fixing roll 1 after being brought into contact therewith. The result of experiments show that the interval X was 0.014 second.

From the foregoing description, it will be understood that when the heat intake of the offset preventing layer 5 was greater than that of the toner image 7, satisfactory results were obtained in fixing the toner image even if there was a drop in the temperature at the surface of the fixing roll 1. The results of tests also show that the resilient material layer 4 has no appreciable influences if the offset preventing layer 5 has the same thickness as the toner image 7. Conversely, it has been found that the resilient material layer 4 has no effects at all when the offset preventing layer 5 has low heat intake, even if the resilient material layer 4 has a markedly high thermal conductivity and its temperature-time characteristic is apparently high.

The toner image 7 generally has a thickness in the range between 30 and 40$\mu$. However, its thickness is reduced to about 20$\mu$ when it is heated under pressure when fixed. Thus the offset preventing layer 5 should have a thickness of over about 20$\mu$. However, when the value of the heat intake $\sqrt{\lambda\cdot\rho\cdot C_p}$ of the resilient material layer 4 is higher than that of the offset preventing layer 5, heat will be immediately supplied from the resilient material layer 4 in the event that the thermal capacity of the toner image 7 becomes higher than that of the offset preventing layer 5. When this is the case, the offset preventing layer 5 may have its thickness reduced to about 10μ, for example, without causing any trouble.

The offset preventing layer 5 used in the present invention is formed of a material, such as silicone RTV rubber, silicone resin, fluorosilicone rubber, fluoride resin, etc., having a thermal conductivity of $4\text{-}6\times10^{-4}$ cal/cm·sec.°C., highly resistant to heat and having a good parting property, which is added with over 1% by weight of metal powder of high thermal conductivity, such as copper powder, aluminum powder, iron oxide powder, red oxide, etc., or over 1% by weight, preferably 3% by weight, of carbon powder of high thermal conductivity and inorganic powder of high consistency.

According to the invention, the offset preventing layer 5 may be formed by applying to the surface of the fixing roll 1 an offset preventing liquid, such as silicone oil or codenatured oil, such as fluorosilicone oil. In this case, an oil resisting layer is preferably formed between the resilient material layer 4 and offset preventing layer 5. The oil resisting layer may be formed of fluorosilicone rubber when silicone oil is applied as the offset preventing layer, and silicone rubber, such as methyl silicone, phenyl, vinyl silicone rubber, etc., may be used to form the oil resisting layer when fluorosilicone oil is applied as the offset preventing layer.

Figure 5:
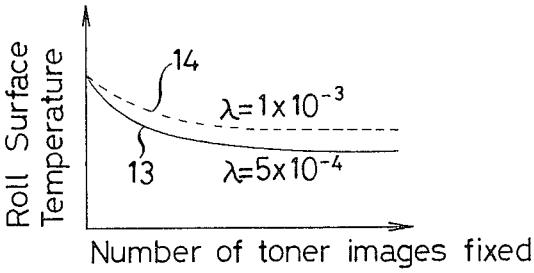
FIG. 5 is a diagram showing the influences of the thermal conductivity of the resilient material layer exerted on a reduction in the temperature at the surface of the fixing roll when fixing of toner images is carried out continuously.

The resilient material layer 4 does not have a high thermal conductivity when it is formed of silicone rubber or fluoroprene rubber, the thermal conductivity being in the range in the range from 4 to $5\times10^{-4}$ cal/cm·sec.°C. Thus when fixing of a plurality of toner images is performed continuously, a delay will occur in the transfer of heat from the metallic core 3 and the temperature at the surface of the fixing roll 1 will gradually drop as the number of toner images treated increases. FIG. 5 shows this phenomenon in diagrammatic form wherein the abscissa represents the number of toner images fixed, and the ordinate indicates the surface temperature of the roll 1. In the diagram shown in FIG. 5, a solid line 13 represents the resilient material layer 4 having a thermal conductivity $\lambda=5\times10^{-4}$ and a broken line 14 represents the resilient material layer 4 having a thermal conductivity $\lambda=1\times10^{-3}$. In the figure, it will be seen that the higher the value of λ, the greater is the drop in the temperature at the surface of the roll 1 caused by continuous fixing of the toner images. The results of tests and theoretical analysis show that when the value of λ is over $1\times10^{-3}$ cal/cm·sec.°C., no problems are encountered in putting the fixing roll according to the invention to practical use.

For information, an average value of heat intake $\sqrt{\lambda\cdot\rho\cdot C_p}$ of each of various groups of commercially available materials will be listed. Paper, 0.01; toner, 0.013; silicone rubber, 0.013; stainless steel, 0.191; iron, 0.33; aluminum, 0.583; and copper, 0.89. All the values are expressed in terms of cal/cm$^2$.°C.sec$^{\frac{1}{2}}$.

From the foregoing description, it will be appreciated that the present invention enables a reduction in the surface temperature of the fixing roll of the image fixing device to be minimized when the fixing roll is used for effecting fixing of toner images formed on the copy sheets. Thus when a plurality of toner images are continuously fixed, a drop in the temperature at the surface of the fixing roll can be avoided which would otherwise occur as time elapses. The invention can prevent production of copes of poorly fixed images due to a reduction in the amount of heat, and also can increase the efficiency of the heating member of the fixing roll.

What is claimed is:

1. An improved image fixing device for a copying apparatus of the type having a fixing roll, the fixing roll including a metallic core, a resilient material layer superposed over the metallic core and an offset preventing layer superposed over the resilient material layer and a heating member disposed in the fixing roll for heating the metallic core; and a pressing roll juxtaposed against the fixing roller and operative to apply pressure to a copy sheet having a toner image formed thereon allowed to pass between the two rolls, so that the toner image formed on the copy sheet can be fixed by melt adhesion by being pressed between the two rolls while being heated;

the improvement wherein the offset preventing layer has a higher heat intake than the toner image formed on the copy sheet, and the offset preventing layer being formed of a synthetic resinous material resistant to heat and having a good parting property, wherein the offset preventing layer being formed of a synthetic resinous material having from about 1% to about 5% by weight of metal powder.

2. An image fixing device as claimed in claim 1, wherein said resilient material layer has a thermal conductivity of over $1\times10^{-3}$ cal/cm°C.sec.

3. An image fixing device as claimed in claim 1 wherein the offset preventing layer has the same thickness as the toner image.

4. An image fixing device as claimed in claim 1 or 2 wherein the offset preventing layer has a thickness greater than 20μ.

5. An image fixing device as set forth in claim 1 wherein the resilient material layer has a heat intake higher than that of the offset preventing layer, and the offset preventing layer has a thickness of approximately 10μ.

6. An image fixing device as set forth in claim 1 wherein the offset preventing layer comprises a material selected from the group consisting of silicone resin, fluorosilicone rubber, and fluoride resin.

* * * * *